US009101218B2

(12) United States Patent
Bradley

(10) Patent No.: US 9,101,218 B2
(45) Date of Patent: Aug. 11, 2015

(54) SEATING SUPPORT SYSTEM

(75) Inventor: James David Bradley, Mound, MN (US)

(73) Assignee: Sico Incorporated, Edina, MN (US)

( * ) Notice: Subject to any disclaimer, the term of this patent is extended or adjusted under 35 U.S.C. 154(b) by 297 days.

(21) Appl. No.: 13/185,150

(22) Filed: Jul. 18, 2011

(65) Prior Publication Data

US 2012/0013152 A1 Jan. 19, 2012

Related U.S. Application Data

(60) Provisional application No. 61/365,723, filed on Jul. 19, 2010.

(51) Int. Cl.

| | |
|---|---|
| ***A47B 3/14*** | (2006.01) |
| ***A47C 9/02*** | (2006.01) |
| *A47B 83/02* | (2006.01) |

(52) U.S. Cl.

CPC . *A47C 9/022* (2013.01); *A47B 3/14* (2013.01); *A47B 83/02* (2013.01); *Y10T 29/49826* (2015.01)

(58) Field of Classification Search

CPC ..... A47B 3/14; A47B 83/02
USPC ..... 297/157.1, 159.1, 461
See application file for complete search history.

(56) References Cited

U.S. PATENT DOCUMENTS

| | | | | |
|---|---|---|---|---|
| 2,498,837 | A * | 2/1950 | Gelman | 297/461 |
| 3,057,659 | A | 10/1962 | Bargen et al. | |
| D194,038 | S | 11/1962 | Preston | |
| 3,075,809 | A | 1/1963 | Wilson | |
| 3,109,678 | A | 11/1963 | Wilson | |
| 3,230,909 | A | 1/1966 | Watson | |
| 3,230,910 | A | 1/1966 | Olsson | |
| 3,366,415 | A | 1/1968 | Cooper | |
| D211,886 | S | 8/1968 | Benjamin | |
| 3,511,532 | A | 5/1970 | Tringali et al. | |
| 3,521,341 | A | 7/1970 | Hornlein et al. | |
| 3,715,143 | A | 2/1973 | Gerken et al. | |
| 3,770,319 | A | 11/1973 | Ono | |
| 4,208,072 | A | 6/1980 | Iskendarian | |
| D266,037 | S | 9/1982 | Heighberger | |
| D268,971 | S | 5/1983 | Reineman | |
| 4,632,410 | A | 12/1986 | Bainbridge et al. | |
| 4,757,968 | A | 7/1988 | Kinanen et al. | |
| 4,798,411 | A | 1/1989 | Lin | |
| 4,921,303 | A | 5/1990 | White | |
| 4,997,232 | A | 3/1991 | Johnsen | |
| 4,998,774 | A | 3/1991 | Huff et al. | |

(Continued)

FOREIGN PATENT DOCUMENTS

| | | |
|---|---|---|
| AU | 57700/94 | 9/1994 |
| DE | 77 03 245 | 5/1977 |

(Continued)

*Primary Examiner* — Peter Brown
(74) *Attorney, Agent, or Firm* — Merchant & Gould P.C.

(57) ABSTRACT

A table and seating arrangement includes a table and seats positioned along at least one edge of the table. The seats define a cavity, at least a portion of the cavity having a non-circular cross-section. A frame supports the seat and the table and includes a seat support. The seat support has a non-uniform cross-section including a lower section having a substantially circular cross-section and an upper section having a non-circular cross section inserting into the cavity of the seat. A caster or glide element mounts to a bottom end of the lower section of the seat support.

10 Claims, 17 Drawing Sheets

(56) References Cited

U.S. PATENT DOCUMENTS

| | | | | |
|---|---|---|---|---|
| 5,112,103 | A | 5/1992 | Downer | |
| 5,236,170 | A | 8/1993 | Johnsen | |
| 5,439,269 | A | 8/1995 | Cheng | |
| 5,730,081 | A * | 3/1998 | Tsengas | 108/156 |
| D413,734 | S | 9/1999 | Bue | |
| 6,010,185 | A | 1/2000 | Petersen | |
| 6,032,589 | A * | 3/2000 | Wang | 248/188.5 |
| 6,065,802 | A | 5/2000 | Bue | |
| 6,074,005 | A | 6/2000 | Simmons | |
| 6,186,591 | B1 | 2/2001 | Pajerski | |
| D439,060 | S | 3/2001 | Larsen | |
| 6,254,178 | B1 | 7/2001 | Bue | |
| D456,155 | S | 4/2002 | DeVriendt | |
| 6,386,628 | B2 | 5/2002 | Bue | |
| D478,732 | S | 8/2003 | Pajerski et al. | |
| D479,406 | S | 9/2003 | Pajerski et al. | |
| D479,773 | S | 9/2003 | Pajerski et al. | |
| 6,749,265 | B1 | 6/2004 | Wang | |
| 6,925,945 | B2 * | 8/2005 | Babick et al. | 108/157.1 |
| 7,226,393 | B2 | 6/2007 | Baker | |
| 7,234,780 | B2 | 6/2007 | Lipniarski | |
| 7,393,049 | B2 | 7/2008 | Chase | |
| D595,969 | S | 7/2009 | Hanusiak et al. | |
| 7,758,113 | B2 | 7/2010 | Hanusiak et al. | |
| D621,172 | S | 8/2010 | Rivera, Jr. et al. | |
| 7,971,930 | B2 | 7/2011 | Larsen et al. | |
| 2006/0232109 | A1 | 10/2006 | Olano | |
| 2006/0238003 | A1 | 10/2006 | Larsen et al. | |

FOREIGN PATENT DOCUMENTS

| | | | |
|---|---|---|---|
| DE | 10 2006 025 088 | A1 | 3/2007 |
| FR | 1025052 | | 4/1953 |
| GB | 2 348 124 | | 9/2000 |

* cited by examiner

SEATING SUPPORT SYSTEM

This application claims benefit of Ser. No. 61/365,723, filed 19 Jul. 2010 in the United States and which application is incorporated herein by reference. To the extent appropriate, a claim of priority is made to the above disclosed application.

BACKGROUND OF THE INVENTION

1. Field of the Invention

The present invention relates to a table and seating apparatus with stool type seats having seat supports that have a non-uniform cross section.

2. Description of the Prior Art

In large, multi-purpose rooms that are utilized at various times as dining rooms, meeting halls, dance areas, training rooms, classrooms and other varied activities, it is often desirable that mobile multi-purpose furniture be used. Such furniture includes tables, chairs, benches and/or stools or table and seat combinations. Table and seating combinations often utilize stool type seats that provide great utility and access for those using the table and seating system. Many table and seating structures are mounted on wheels or casters for easy transport. The units may also be foldable for easy storage.

A challenge for such systems and especially such systems that are utilized in schools is resistance to abuse by users, especially when used by teenaged children. The stool type seats for these systems are typically a lightweight molded plastic that mount to a vertical tubular support post. Although such seats are generally lightweight and provide high strength and are adequate for supporting users, such seats may be open to abuse by the users. Such seats are typically bolted to the seat support with a horizontally extending bolt. Through abuse, the bolt may be dislodged, sheared or break through the plastic lower section of the seat. If this occurs and the bolt does not retain the seat, students or other users may further abuse the seat by twisting. Where the top edge of the tubular support post is round, such twisting may act as a bore and may eventually break through the upper surface of the seat, thereby ruining the seat.

To provide a seat that cannot rotate, a seating system has been developed that has a square seat support and a seat having a corresponding square portion engaging the square seat support. Such a system was developed by Sico Incorporated over 30 years ago. Another system is also shown in U.S. Pat. No. D595,969 and U.S. Pat. No. 7,758,113.

Although such a system prevents rotation and damage caused by a circular top and of a seat support boring through a plastic seat, the configuration has several drawbacks. Table and seating systems that utilize such seats often are mounted on casters. Conventional casters use an upwardly extending round pin to mount into the lower end of a round tubular frame member. To mount the caster with a round pin into the bottom of a square channel, an adapter must often be used. Alternatively, an adapter of mounting member may be welded or otherwise attached to the square tube to provide for mounting the upwardly extending mounting pin of a caster. However, if the casters are offset from the frame member, the balance of such systems, especially folding systems, may be adversely affected and cause problems for folding and/or unfolding.

It can be seen then that a new system is needed that provides a sturdy and reliable seat that prevents abuses and damage due to rotation of the seats on a round support. Moreover, such a system should overcome the drawbacks associated with using square tubular members as a frame and mounting of casters. The present invention addresses these as well as other problems associated with table and seating systems and their seats and seat supports.

SUMMARY OF THE INVENTION

The present invention is directed to a table and seating apparatus and to a seat having a seat support having a non-uniform cross-section, including a portion with a circular cross section and a portion with a non-circular cross section.

The table and seating system includes a table with a frame supporting stool type seating spaced around the edge or along the sides of the table top. The framework includes a folding mechanism in one embodiment to provide for folding between an extended use position and a storage position. The framework is supported on casters or glides that are configured for engaging the floor and mounting to the lower portion of the circular, tubular type frame elements. The casters include an upwardly extending mounting pin that inserts into the bottom opening of the tubular frame member.

Each of the seats includes a stool type seat portion. The seat portion generally includes a round upper seating surface and a stem extending downward. The seat elements are generally molded plastic elements and may include support ribs radiating from the stem on an underside of the seat portion. The stem defines a downward facing cavity. At least a portion of the cavity has a noncircular cross section for receiving a corresponding seat support extending upward from the frame.

The seat support includes a lower portion having a circular cross section and an upper portion have a non-circular outer perimeter complementary to the cross section of the down extending cavity of the seat element. The complementary non-circular cross sections align and engage one another to prevent the seat element from rotating relative to the seat support. In addition, a bolt or other fastener extends horizontally through mounting holes in both the seat and the seat support. The seat support has a lower portion with a circular cross section to receive a cylindrical pin or mounting portion of a glide element. The top portion of the seat support having a non-circular cross section may be a crimped section of the seat support tubing. The upper section having a non-circular cross section and the lower section having a circular cross section are vertically aligned in one embodiment. The non-uniform cross section of the seat support is easily manufactured and provides the benefits of preventing rotation of the seat relative to the seat support while easily accepting round mounting members that insert into a lower round opening in the bottom of the seat support. Such a configuration may also provide greater strength and resistance to torque.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT

Figures 1, 4:
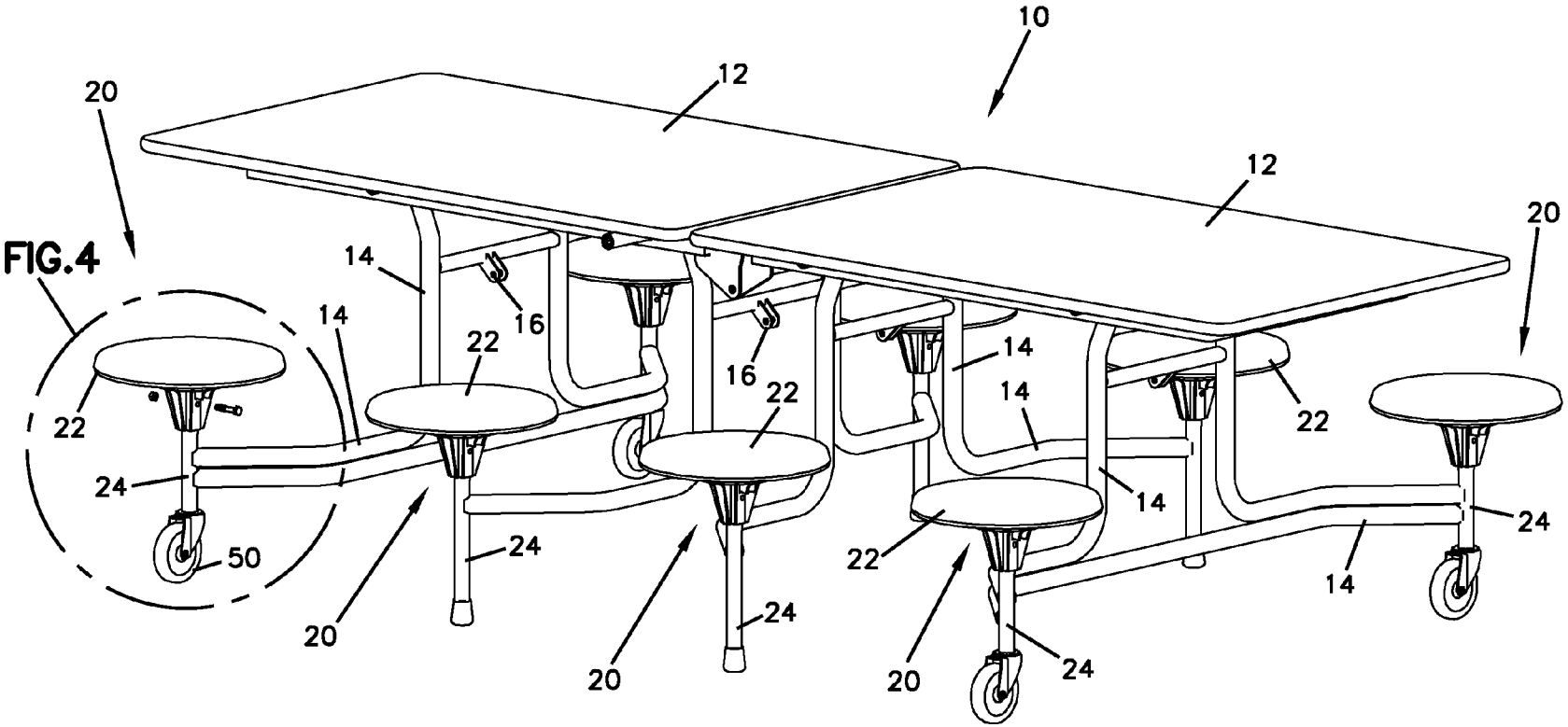
FIG. 1 is a perspective view of a table and seating apparatus in an unfolded use position according to the principles of the present invention.
FIG. 4 is a perspective view of a seat assembly for the table and seating apparatus shown in FIG. 1.
Figure 2:
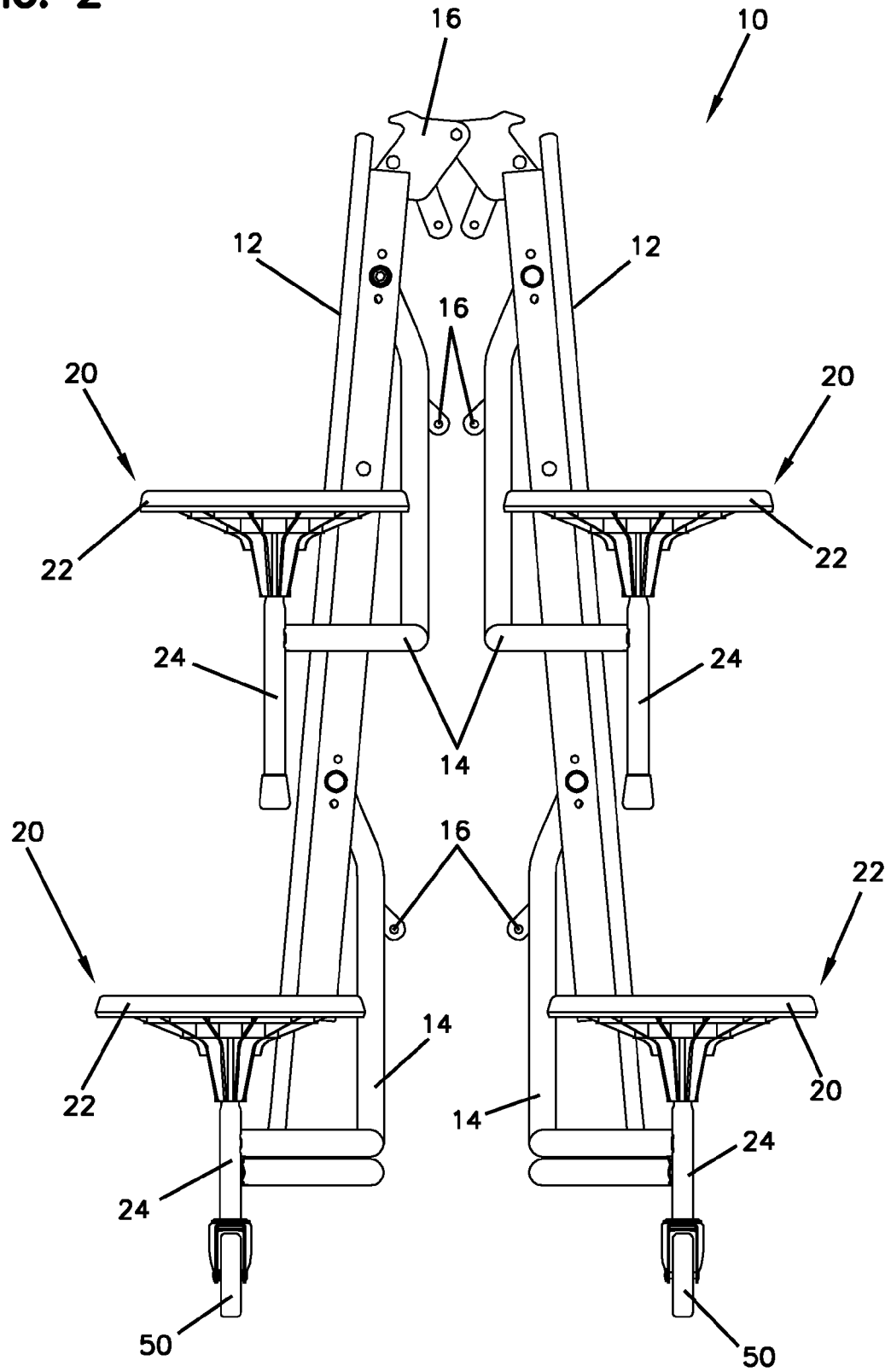
FIG. 2 is an end view of the table and seating apparatus shown in FIG. 1 in a folded storage position.
Figure 3:
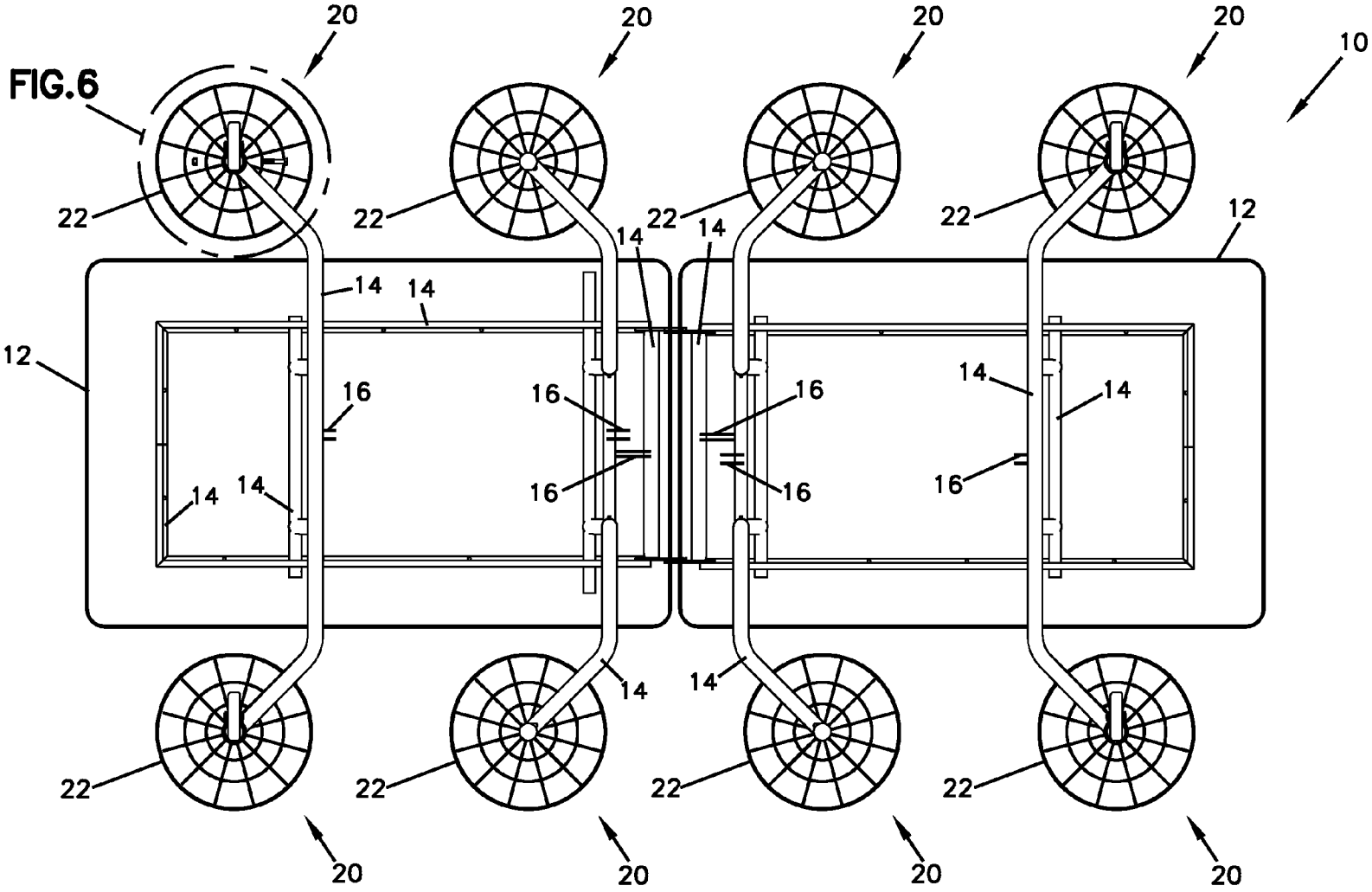
FIG. 3 is a bottom view of the table and seating apparatus shown in FIG. 1.
Figure 4:
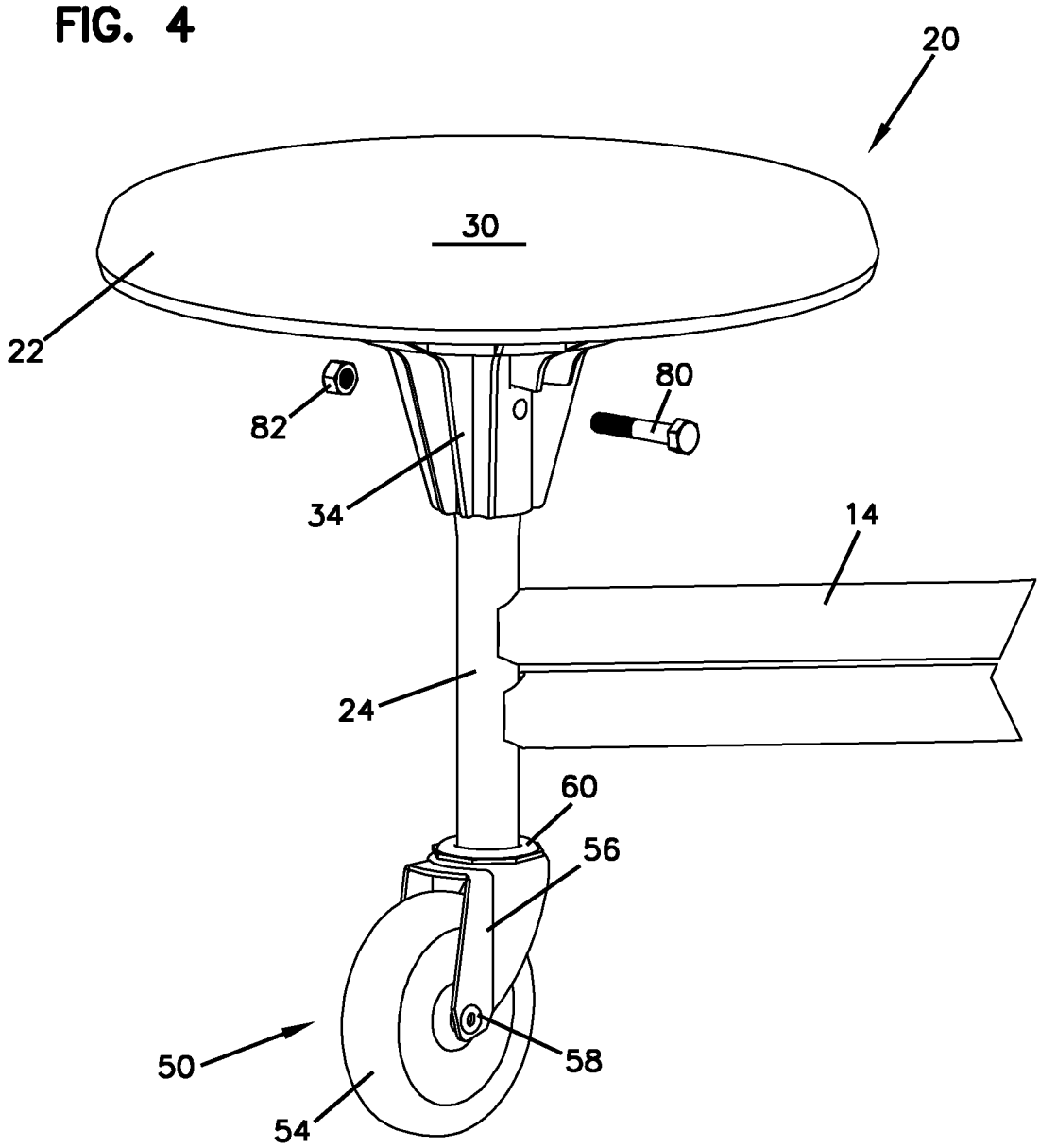

Referring now to the drawings, and in particular to FIGS. 1-3, there is shown a table and seating apparatus, generally designated 10. The table and seating apparatus 10 includes a pair of tabletops 12 supported by a framework 14. The framework 14 has tubular frame members having a generally round cross-section that are joined together by welding or other known conventional techniques. In the embodiment shown, the table and seating apparatus 10 is a folding system and a folding linkage 16 provides for folding between a folded storage position shown in FIG. 2 and an extended use position shown in FIGS. 1 and 3. Portions of the linkage 16 have been removed for clarity. It can be appreciated that the present invention may be utilized with other table and seating arrangements, including those that are not folding. The table and seating system also includes seat assemblies 20, including seats 22 and seat supports 24.

Figure 7:
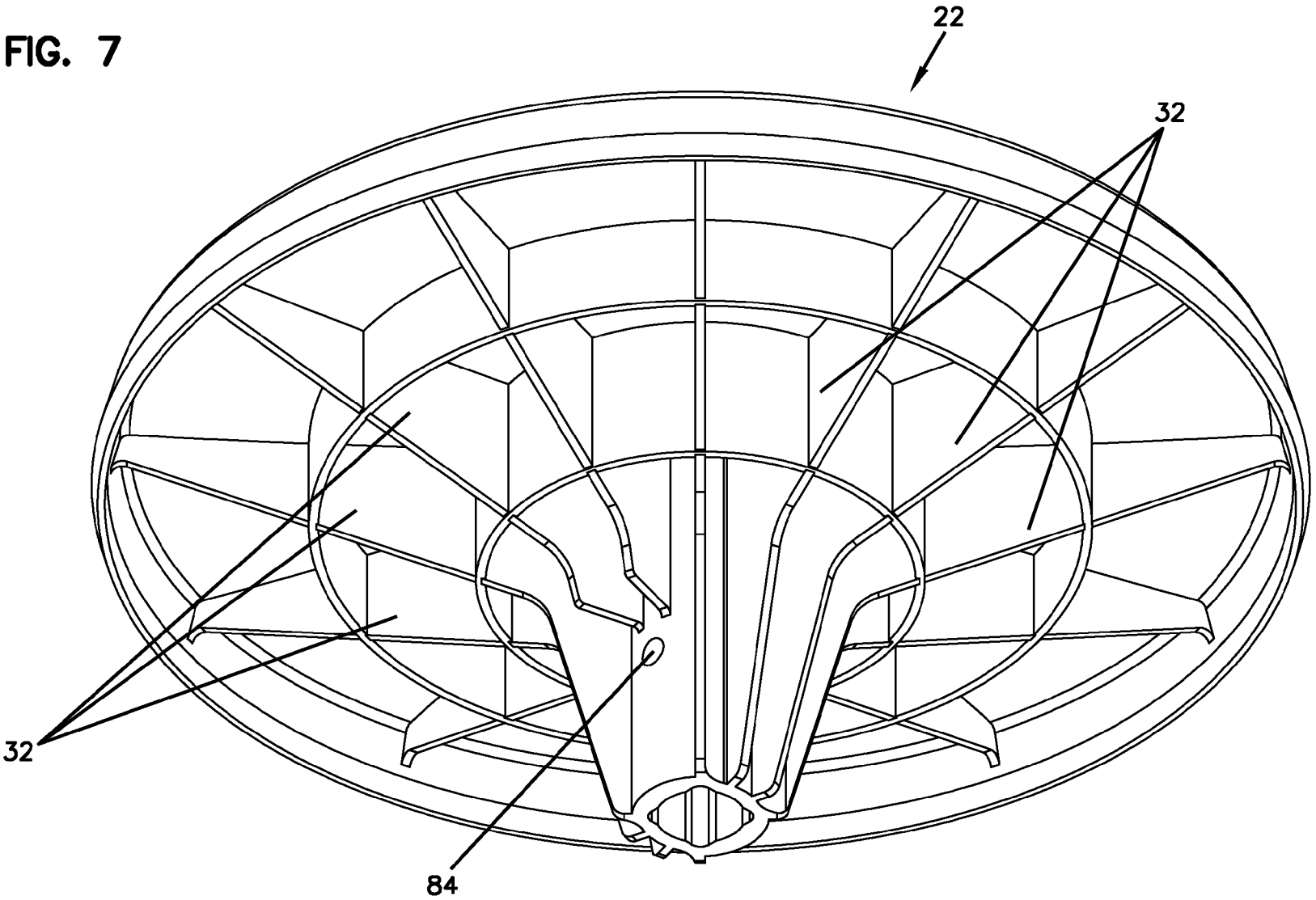
FIG. 7 is a bottom perspective view of a seat element for the seat assembly shown in FIG. 4.
Figure 8:
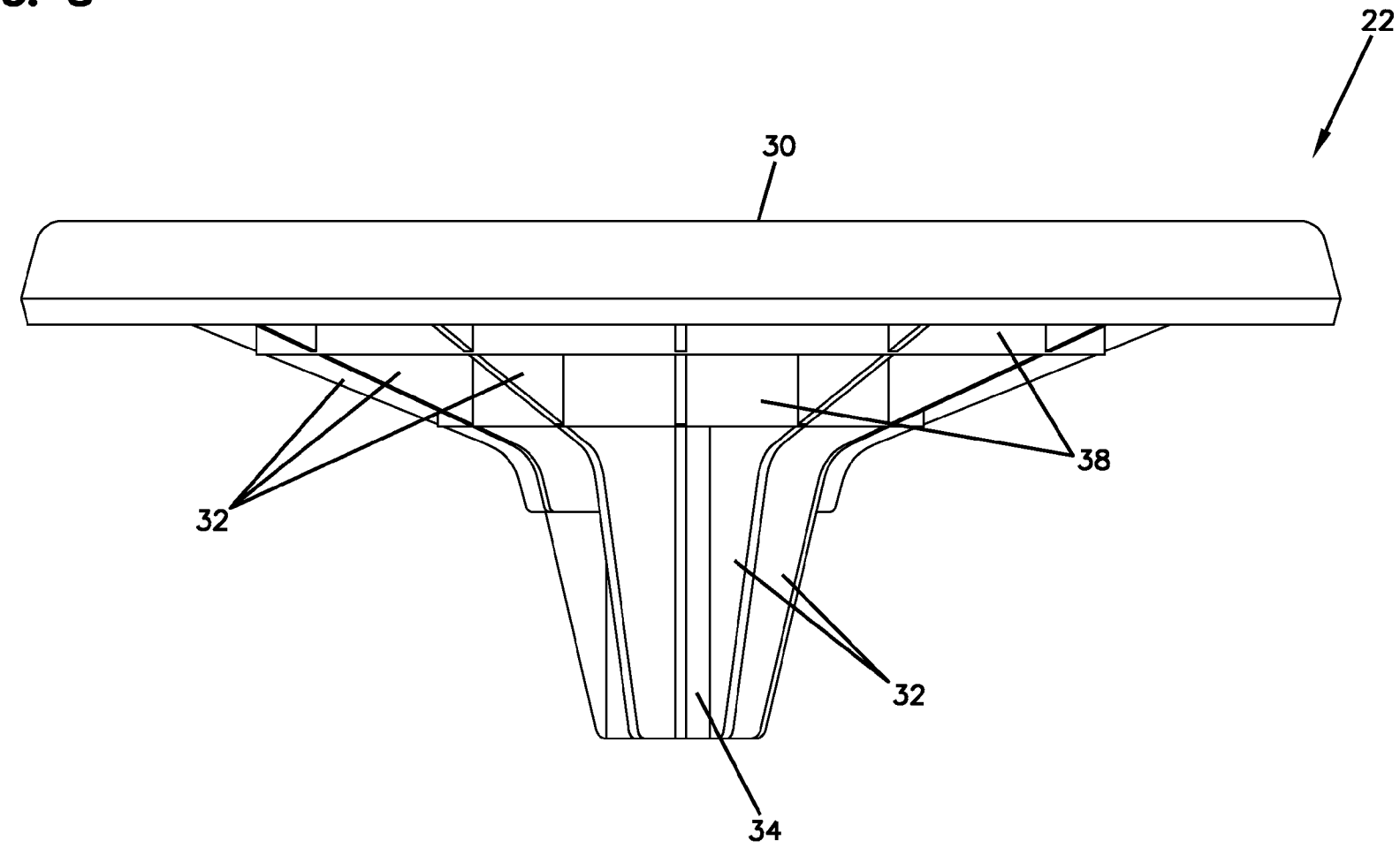
FIG. 8 is a side elevational view of the seat element shown in FIG. 7.
Figure 9:
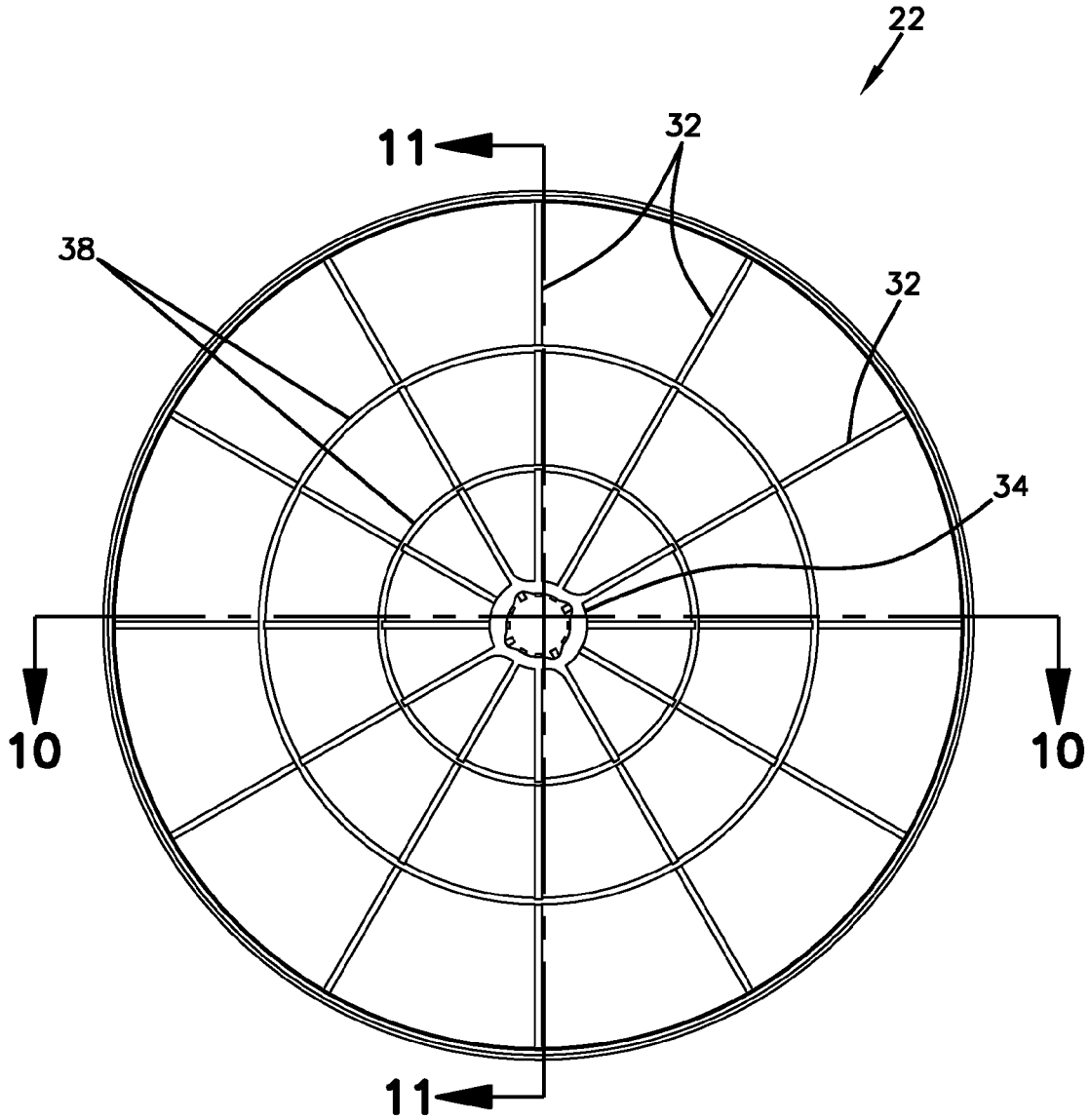
FIG. 9 is a bottom plan view of the seat element shown in FIG. 7.
Figure 10:
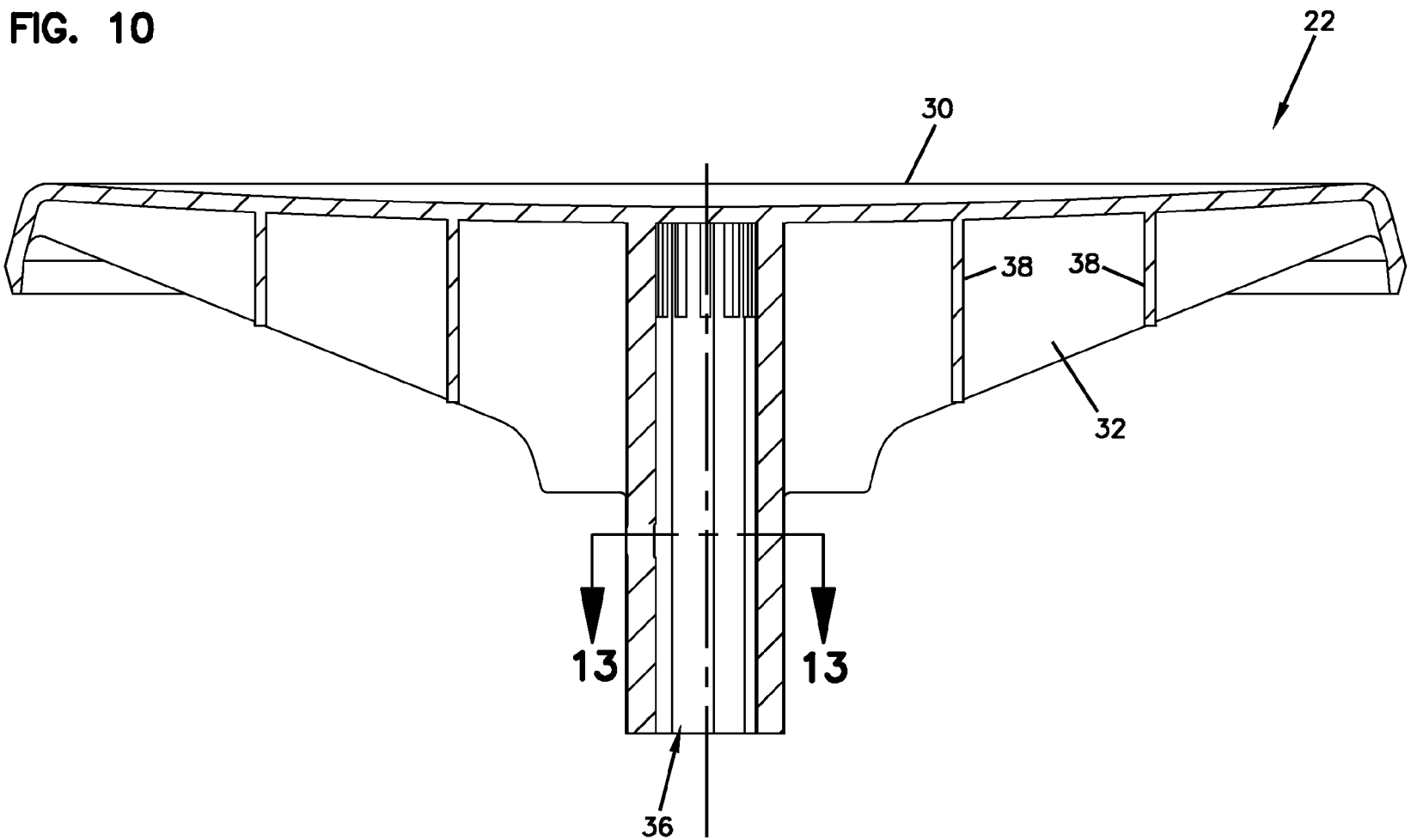
FIG. 10 is a sectional view of the seat element shown in FIG. 9 taken along sectional line 10-10.
Figure 11:
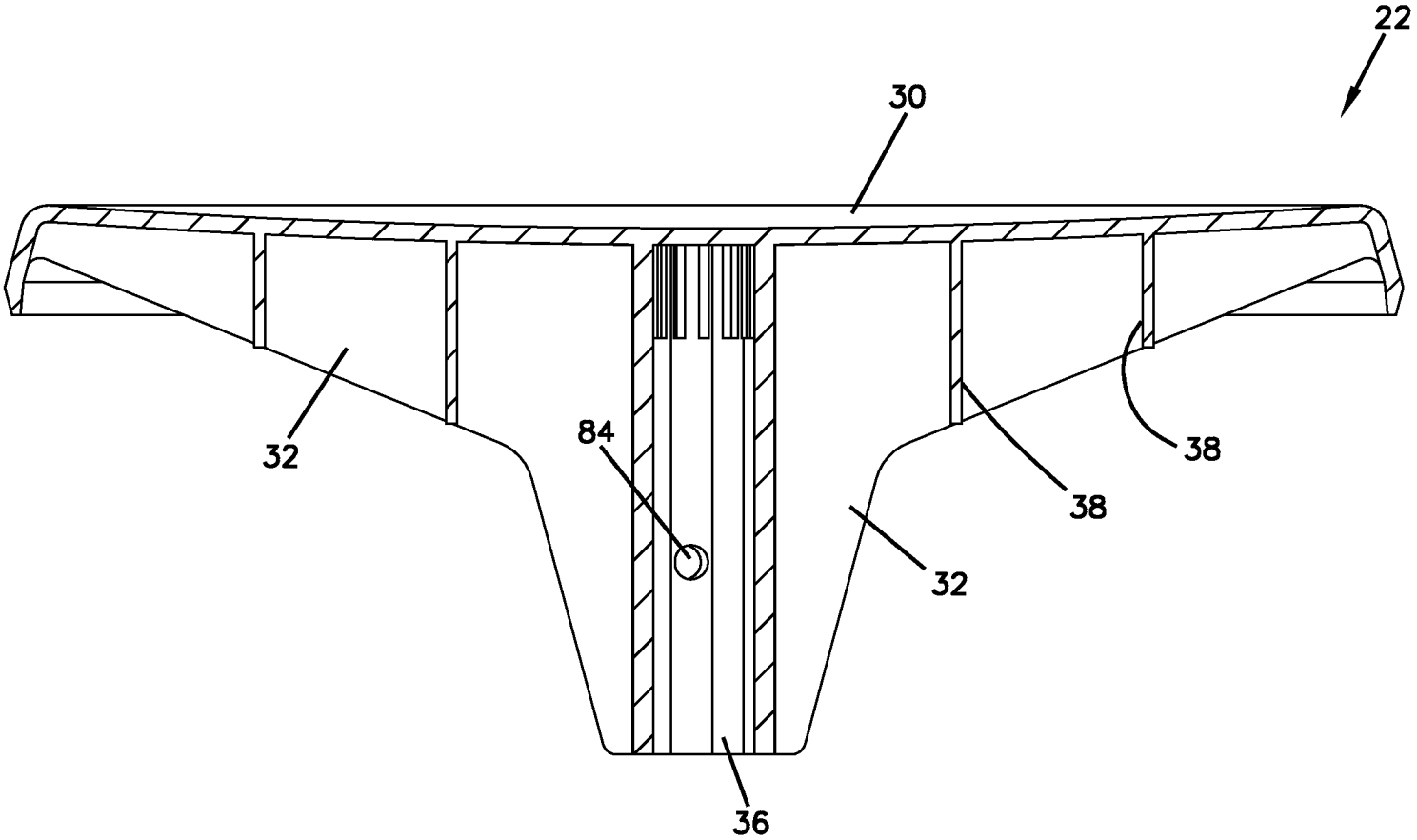
FIG. 11 is a sectional view of the seat element shown in FIG. 9 taken along sectional line 11-11.
Figure 12:
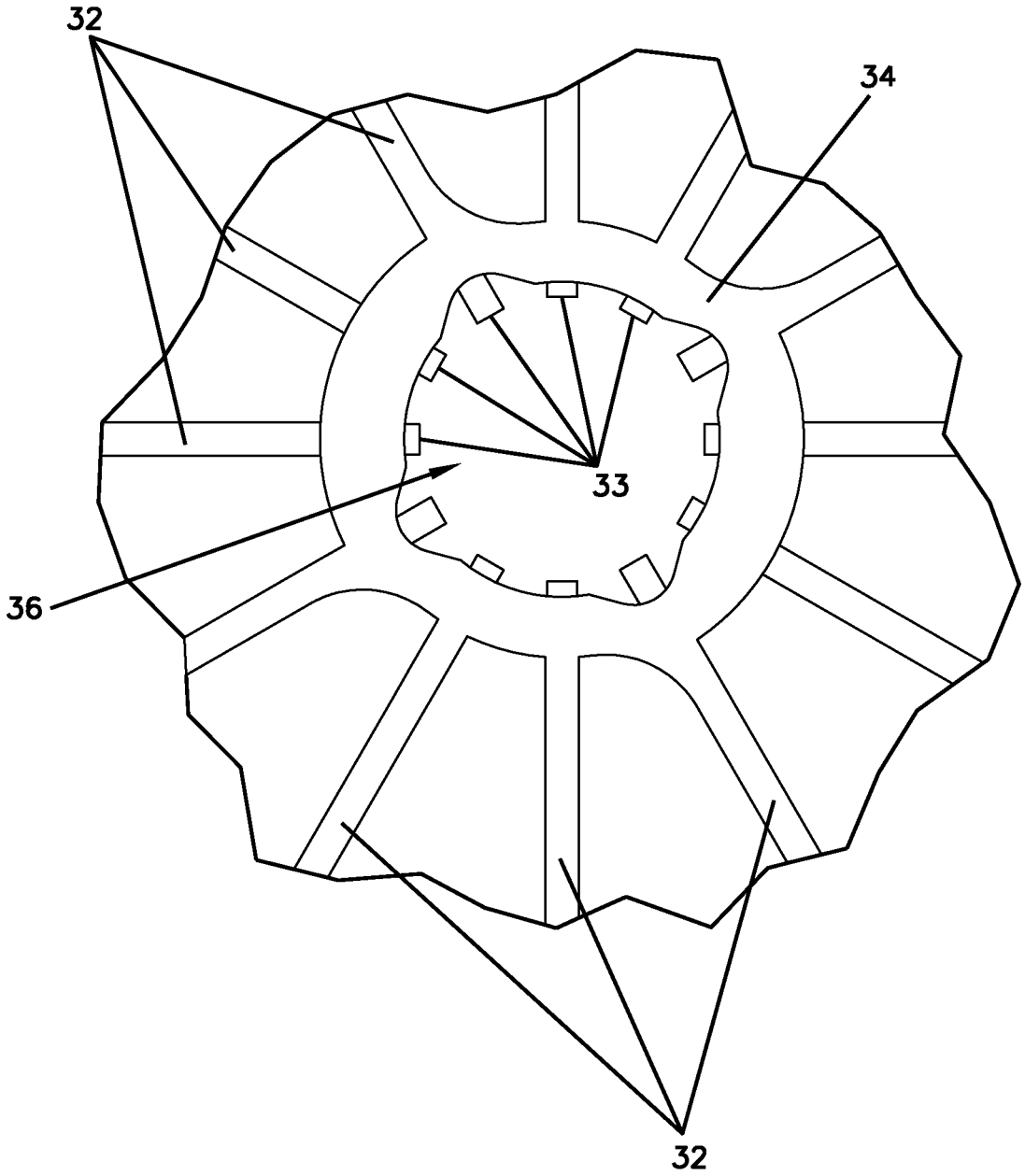
FIG. 12 is a bottom detail view of a stem for the seat element shown in FIG. 7.
Figure 13:
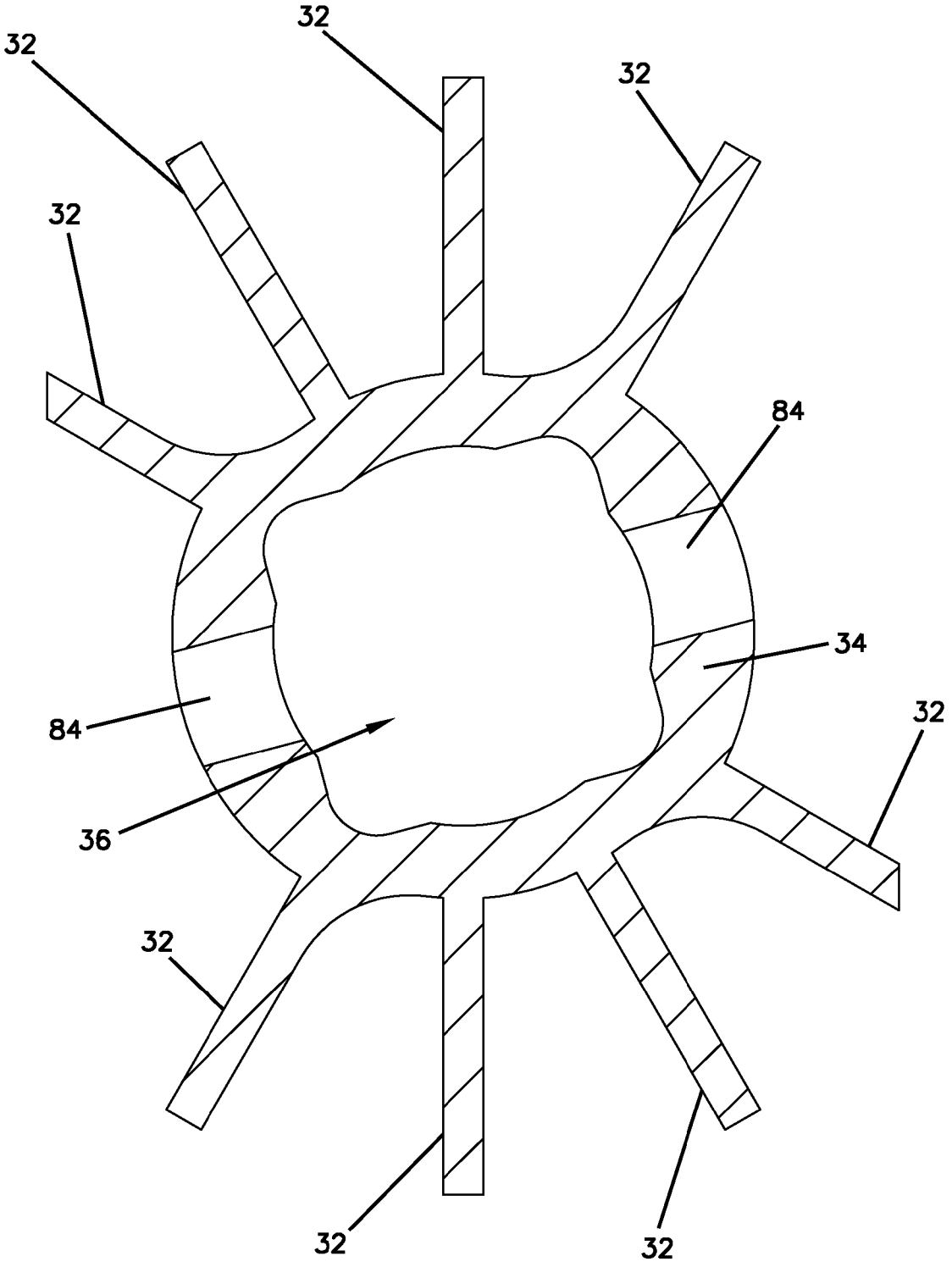
FIG. 13 is a bottom sectional view taken along sectional line 13-13 in FIG. 10.

As shown most clearly in FIGS. 4-11, the seats 22 are molded round seat elements. Each of the seats 22 is a generally round element having an upper seating surface 30 that may have a slight depression. Radially extending ribs 32 and annular ribs 38 provide support and strength while achieving a lightweight seat element 22. A stem 34 extends downward from an underside of the center of the seat 22. The stem 34 defines a cavity 36, shown in FIGS. 9-13. The stem 34 includes a mounting orifice 84 configured for receiving a retainer device, such as a transversely extending bolt 80 coupled to a complementary nut 82. To provide improved access, the radially extending support ribs 32 above the orifice 84 do not extend longitudinally along the stem as far as other of the radially extending ribs 32, as shown in FIG. 7 and as contrasted in FIGS. 12 and 13. The cavity 36 has at least a portion having a non-circular cross section configured for receiving a complementary shaped section of the framework, as explained hereinafter. As shown most clearly in sectional views of FIGS. 12 and 13, the cavity 36 defines a generally square inner cross-section configured for receiving a seat support. At the innermost portion of the cavity 36 near the seating surface 30, innermost portions 33 of the radial support ribs 32 protrude into the cavity.

Figure 5:
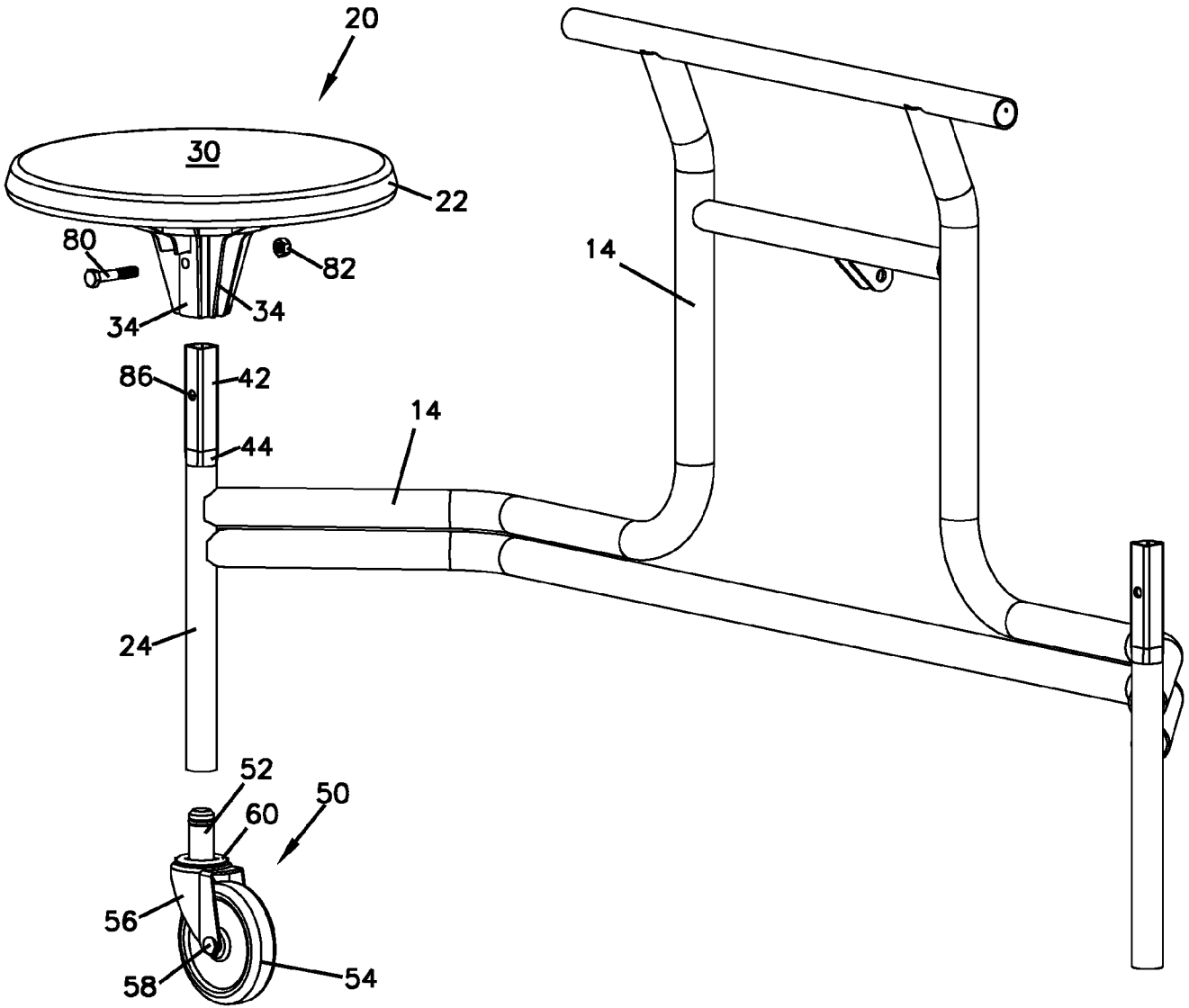
FIG. 5 is an exploded perspective view of the seat assembly shown in FIG. 4.
Figure 6:
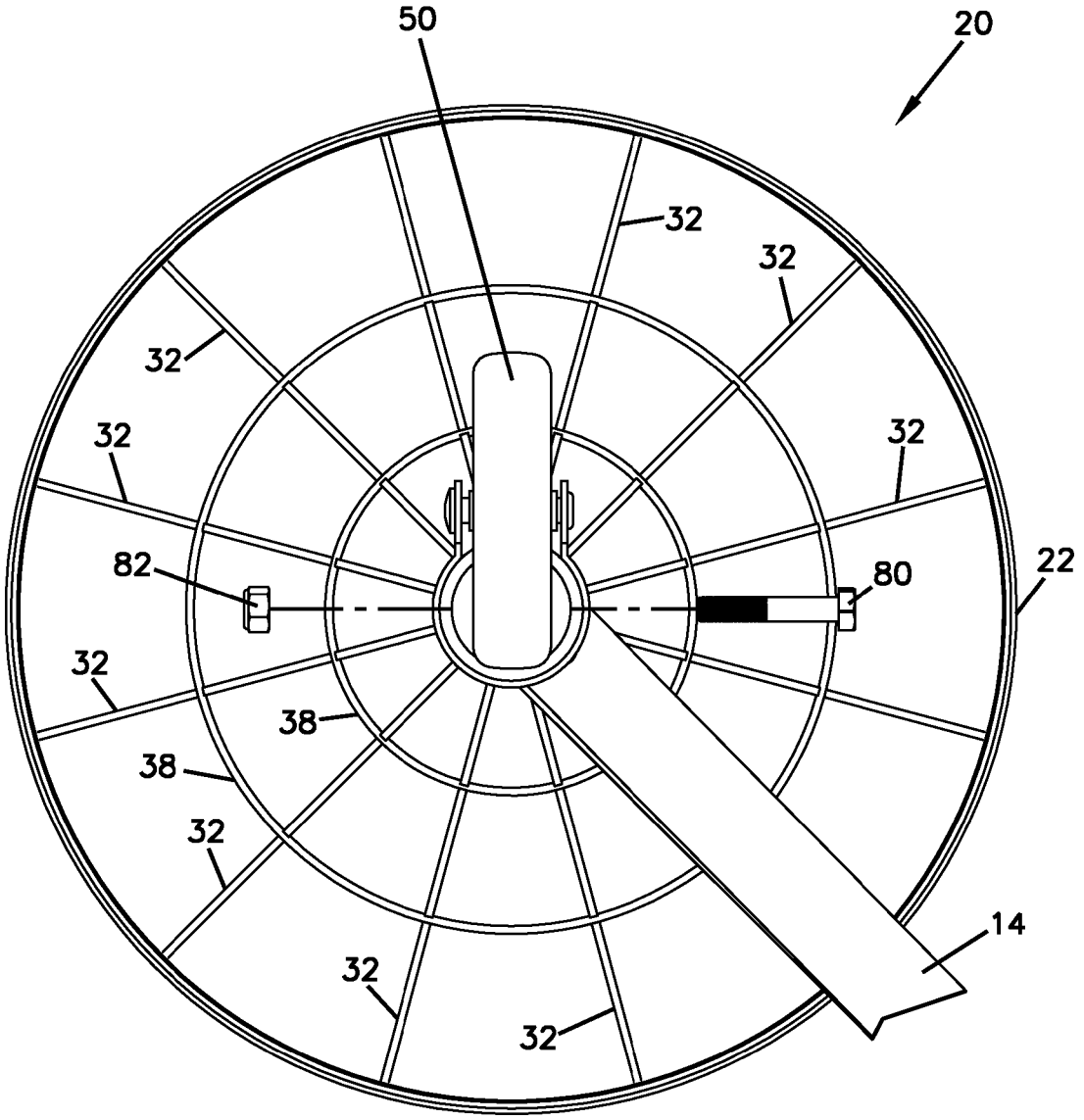
FIG. 6 is a bottom plan view of the seat assembly shown in FIG. 4.
Figure 14:
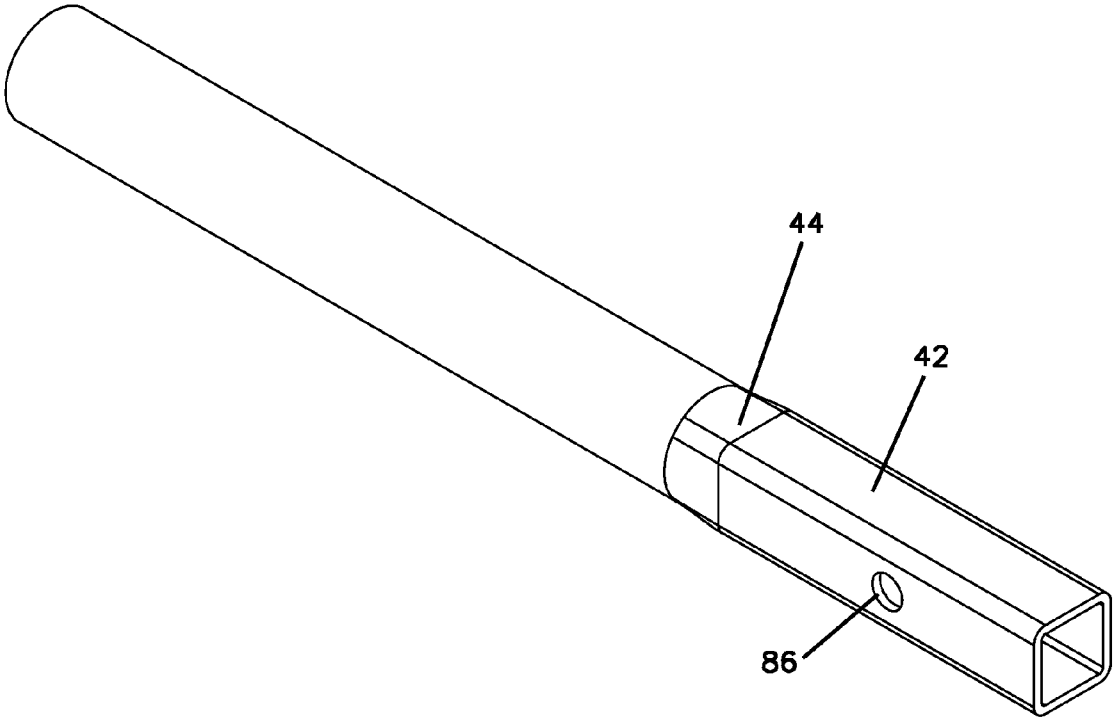
FIG. 14 is a perspective view of a seat support for the seat assembly shown in FIG. 4.
Figure 15:
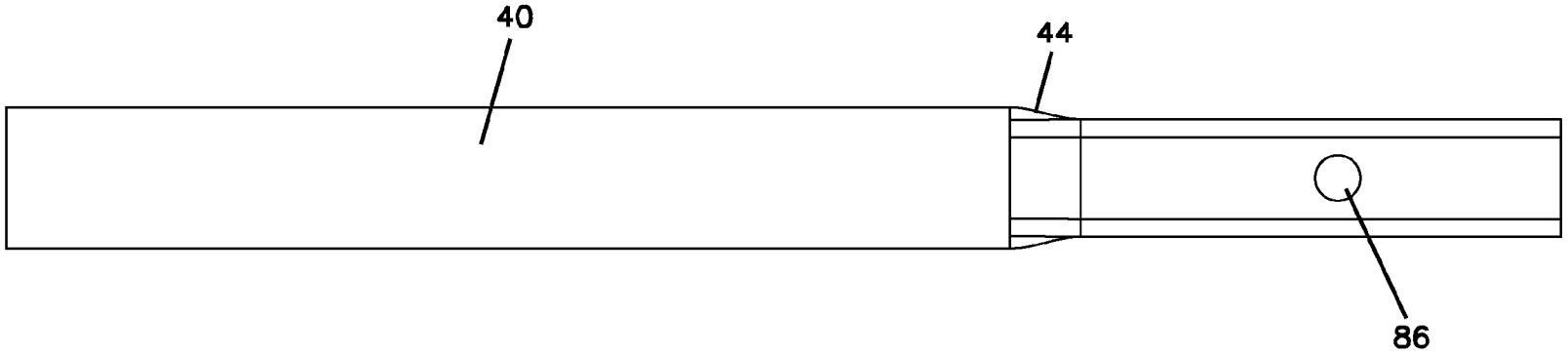
FIG. 15 is a side elevational view of the seat support shown in FIG. 14.
Figure 16:
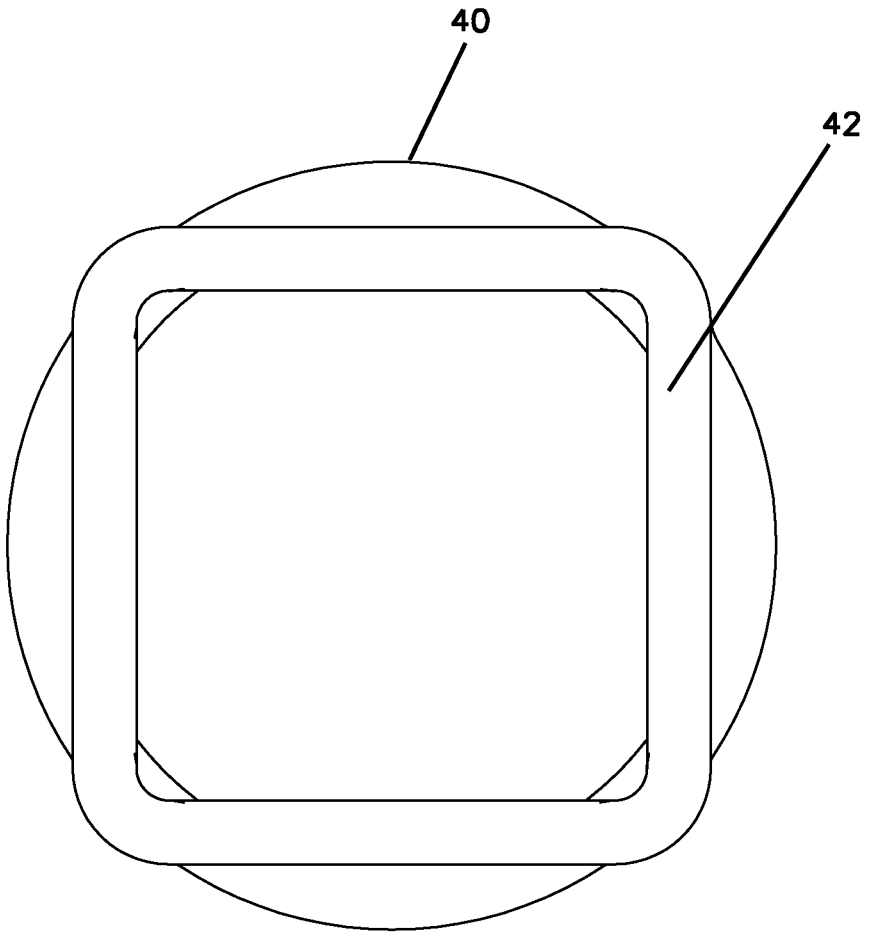
FIG. 16 is a top plan view of the seat support shown in FIG. 16.

Referring to FIGS. 14-16, the seat support 24 includes a lower section 40 having a circular cross section and an upper section 42 having a non-circular cross section. The seat support 24 also has a transition section 44. A mounting orifice 86 receives the retainer bolt 80 and is aligned with the orifice 84 in the stem 34, as shown in FIG. 5 and when mounted, prevents the seat 22 from being lifted off the seat support 24. The seat support 24 is a vertically extending generally tubular member forming a portion of the frame 14. In the embodiment shown, the upper non-circular section 42 has a square cross-section. The non-circular section 42 is a crimped portion of a tubular member of the framework 14 in one embodiment. The crimped portion upper section 42 obtains a non-circular cross section with outermost portions configured to engage the complementary substantially square cross-section of the cavity 36. The tubular construction provides for improved mounting of conventional ground engaging members as explained hereinafter and provides for use of only tubular elements for manufacture rather than requiring square members, complicating certain mountings and construction.

In the embodiment shown, the crimped upper section 42 of the seat support 24 has outer corners engaging the outer corners of the complementary roughly square cavity 36. The innermost portions 33 of the support ribs 32 that protrude into the cavity 36 engage and retain the crimped structure of the upper section 42 of the seat support 24. The engagement between the non-circular cross sections of the cavity 36 of the stem 34 of the seat 20 and the upper section 42 of the seat support 24 prevents rotation of the seats 22 on the seat supports 24

Figure 17:
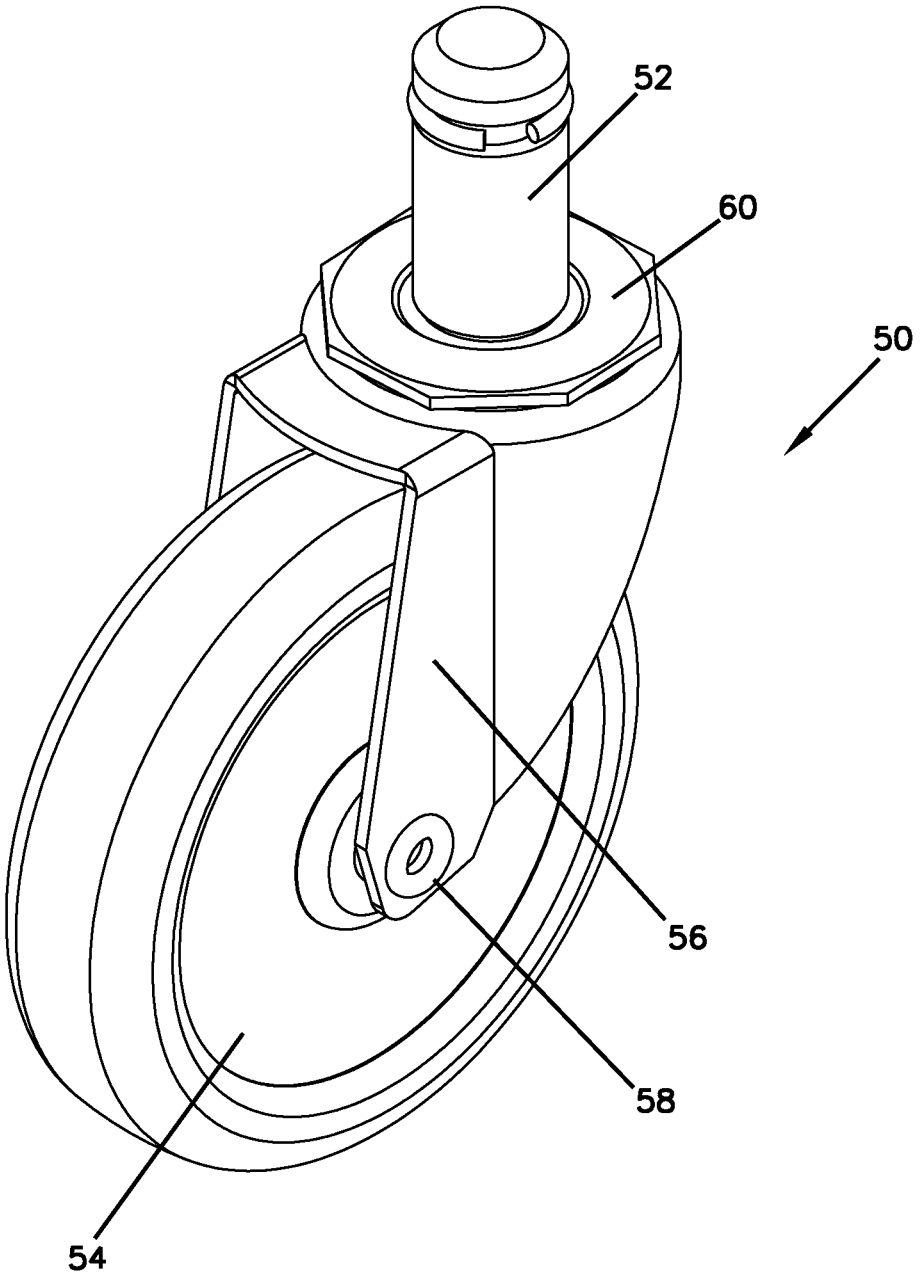
FIG. 17 is a perspective view of a caster for the table and seating apparatus shown in FIG. 1.

As shown in FIG. 17, conventional casters 50 include a roller 54, a framework 56 and a pin 58 serving as an axle for the roller 54. In addition, each caster 50 may include a swivel 60. The caster 50 includes a cylindrical mounting pin 52 extending vertically upward and configured for extending into the bottom end of the circular cross-section of the lower section 40 of the seat support 24. The cylindrical pin 58 extends into the round cavity formed in the tubular circular lower section 40 of the seat support 24.

Referring again to FIG. 1-3, the table and seating apparatus 10 may also include glides 70. The glides 70 may be used in place of the casters 50 or a combination of casters 50 and glides 70 may be utilized, depending upon the configuration and use requirements of the table and seating apparatus 10. The glide 70 includes a bottom ground engaging surface and an upper pin portion similar to the upper portion of a caster. The upper pin portion is a cylindrical mounting element that inserts into the bottom end of the lower circular section 40 of the seat support 24 in a manner similar to that of the mounting pin 52 of the caster 50. It can be appreciated that the seat supports extend down further if a glide 70 is used rather than a caster 50, but the glides and casters are otherwise interchangeably mounted into a lower end of a tubular frame member . . .

It can be appreciated that the present invention provides a seat element 22 having improved strength and a seat assembly 20 providing ease of manufacture. Moreover, the seat mounting system provides for a reliable mounting that overcomes the problems associated with abuse of seats and possible twisting of seats and potentially boring through the top of a plastic seat element. The present invention also maintains conventional mounting of casters and floor glides into tubular frame portions without adapters or additional mounting members.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A table and seating apparatus, comprising:

a table;

a seat, the seat defining a bottom cavity;

a frame supporting the seat and the table, the frame includes a seat support comprising a lower section having a substantially circular cross-section and a top section having a non-circular cross-section;

the bottom cavity of the seat defining an upper portion, and a lower portion having a non-circular cross-section engaging the top section of the seat support; wherein a plurality of ribs extend radially inward only into the upper portion of the bottom cavity of the seat; the bottom cavity of the seat being co-axially aligned with the seat support; the top section of the seat support inserting into and engaging the non-circular cross-section of the bottom portion of the bottom cavity of the seat; wherein the lower portion of the bottom cavity of the seat comprises a plurality of radially innermost spaced apart arcing inner surfaces; and a ground engaging element mounting to a bottom end of a lower section of the frame.

2. A table and seating apparatus according to claim 1, wherein the upper section and lower section of the frame are vertically aligned.

3. A table and seating apparatus according to claim 1, wherein the frame further comprises a cross-member mounted to the seat support, the cross member comprising a substantially round tube.

4. A table and seating apparatus according to claim 1, wherein the ground engaging element comprises a glide.

5. A table and seating apparatus according to claim 1, wherein the ground engaging element comprises a caster.

6. A table and seating apparatus according to claim 5, wherein the caster comprises a pin inserting into the lower portion of the frame.

7. A table and seating apparatus according to claim 1, wherein the seat comprises a molded seat.

8. A table and seating apparatus according to claim 1, wherein the table and seating apparatus comprises a plurality of seats and a corresponding plurality of seat supports.

9. A table and seating apparatus according to claim 1, further comprising a retainer attaching the seat to the frame seat support.

10. A seat assembly for a table and seat apparatus, comprising:

a seat, the seat defining a bottom cavity having an upper portion and a lower portion, the lower portion having a non-circular cross-section and comprising a plurality of radially innermost spaced apart arcing inner surfaces; wherein a plurality of ribs extend radially inward only into the upper portion of the bottom cavity of the seat;

a frame supporting the seat including a seat support, the seat support comprising a tube having a lower section having a substantially round cross-section and an upper section having a non-circular cross-section, the upper section inserting into the lower portion of the bottom cavity and engaging the non-circular cross-section of the lower portion of the bottom cavity; wherein the bottom cavity of the seat defines a first longitudinal axis and the frame defines a second longitudinal axis, and wherein the first longitudinal axis and the second longitudinal axis are aligned; and a ground engaging element mounting to a bottom end of a lower section of the frame.

* * * * *